United States Patent [19]

Bouche

[11] Patent Number: 5,005,759

[45] Date of Patent: Apr. 9, 1991

[54] SNAP-LOCK BOX

[76] Inventor: Alain Bouche, 20 Impasse du Pigeonnier, Orvault, France, 44700

[21] Appl. No.: 477,823

[22] PCT Filed: Dec. 14, 1988

[86] PCT No.: PCT/FR88/00611

§ 371 Date: Apr. 25, 1990

§ 102(e) Date: Apr. 25, 1990

[87] PCT Pub. No.: WO90/06886

PCT Pub. Date: Jun. 28, 1990

[51] Int. Cl.[5] ..... B65D 5/02; B65D 5/64

[52] U.S. Cl. ..... 229/125.260; 206/446; 220/307; 229/5.5

[58] Field of Search ..... 206/446, 45.14; 215/12.1; 220/307; 229/5.5, 5.8, 93, 125.26, 125.28, 125.32

[56] References Cited

U.S. PATENT DOCUMENTS

| | | | |
|---|---|---|---|
| 560,227 | 5/1896 | McKenzie et al. | 229/5.5 |
| 597,726 | 1/1898 | Lovell | 206/446 |
| 2,025,589 | 12/1935 | Huye | 229/125.26 |
| 2,456,841 | 12/1948 | Rushing | 229/125.26 |
| 2,726,803 | 12/1955 | Ketler | 229/5.5 |
| 2,974,825 | 3/1961 | Ross | 229/5.5 |
| 3,851,812 | 12/1974 | Bittel | 229/5.5 |
| 3,941,300 | 3/1976 | Troth | 229/5.5 |
| 4,438,864 | 3/1984 | Helms | 229/5.5 |
| 4,801,039 | 1/1989 | McCall et al. | 220/307 |

FOREIGN PATENT DOCUMENTS

| | | | |
|---|---|---|---|
| 0560401 | 9/1957 | Belgium . | |
| 0079547 | 5/1983 | European Pat. Off. . | |
| 2903546 | 8/1980 | Fed. Rep. of Germany | 220/307 |
| 3216718 | 12/1982 | Fed. Rep. of Germany . | |
| 1351352 | 12/1963 | France | 220/307 |
| 1482162 | 4/1967 | France | 220/307 |
| 2050872 | 4/1971 | France . | |
| 2162290 | 7/1973 | France . | |
| 2317175 | 2/1977 | France . | |

OTHER PUBLICATIONS

A copy of the International Search Report and Annex.

*Primary Examiner*—Jimmy G. Foster

*Attorney, Agent, or Firm*—Sandler, Greenblum & Bernstein

[57] ABSTRACT

Snap-lock box for products, and in particular bottles, having a cardboard sleeve and at least one stopper which forms the base and/or lid of the box. The stopper is a separate stopper made from plastic material, and includes on its side wall lugs which interact with anchoring elements in the form of locking tabs arranged on at least one of the ends of the sleeve which are equipped with notches.

11 Claims, 2 Drawing Sheets

SNAP-LOCK BOX

1. Field of the Invention

The present invention relates to the field of packaging and more particularly to snap-lock boxes consisting of a sleeve interacting with at least one stopper.

2. Description of Background and Relevant Material

Packaging systems intended to pack and to protect products are generally produced in a very simple manner from a cardboard blank, sometimes decorated, having a base and a lid.

In certain embodiments the cardboard used, which is relatively flexible, does not ensure satisfactory resistance both to compression, in the region of the lateral walls, and to crushing when the products are stacked, which poses problems of the contents being damaged or storage problems.

Since the packaging is obtained from a single cardboard blank, it is necessary to provide lateral extensions for the lid and the base, which considerably increases the surface area of cardboard required to obtain the appropriate blank.

Lastly, closing of the box is generally performed by adhesive bonding, or even simply by inserting a tongue of the lid, which does not ensure the locking and hence the impregnability of the packaging. Impregnability of the packaging is increasingly desirable, especially in supermarkets.

SUMMARY OF THE INVENTION

The object of the present invention is to provide a snap-lock lock box capable of being used, but not exclusively so, for the packing of bottles, which permits the above-discussed disadvantages to be overcome.

A first object of the invention is to provide a lockable packing box of an impregnable nature, which permits access to the product only by damaging the packaging.

Another object is to produce a packing combining the wedge-fastening of the contents and satisfactory resistance to compression.

According to the invention, the snap-lock box consists a cardboard sleeve and of at least one separate stopper having, on its flanks, lugs which interact with anchoring means arranged on at least one of the ends of the cardboard sleeve.

Still according to the invention, the sleeve is formed from a single cardboard blank comprising, for example, four lateral walls extended, over at least one side forming an end, by anchoring means in the form of locking tabs. When the box is shaped, these tabs are intended to be folded back towards the inside in order to interact with the lugs of the stopper.

According to a particular arrangement, the locking tabs have notches which interact with the lugs of the stopper in order to achieve the locking of the whole.

Still according to another object of the invention, the stopper intended to form the base and/or the lid of the box consists of a central body whose shape enables it to enter inside the end of the sleeve, and of a flat surface, forming a cap or base, integral with the central body and resting against the edge of the end of the sleeve. The size of this flat surface corresponds at least to that of the sleeve.

According to another arrangement of the invention, the central body of the stopper is recessed and the shape of this recess is well-shaped or matched to the contents so as to achieve its wedge-fastening.

To effect correct locking, the lugs of the stopper are hook-shaped and have a triangular appearance.

By this group of features, which can be employed individually or in combination, the invention enables a packaging to be obtained which effectively protects the products from any damage as a result of the stoppers conferring upon the packing a good resistance and ensuring a correct and accurate wedge-fastening of the products.

This type of box also permits savings in cardboard to be made and ensures a definitive closing which can only be removed by damage.

BRIEF DESCRIPTION OF DRAWINGS

The invention will be further illustrated, without being limited in any way, by the following description of some embodiments, given by way of example, and shown in the attached drawings, in which.

Figure 1:
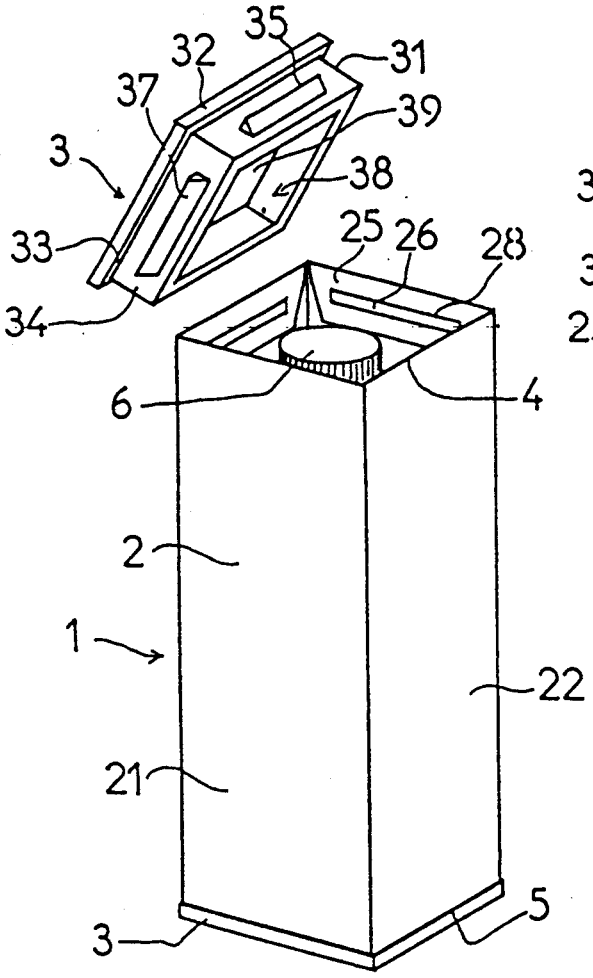
FIG. 1 is a perspective view of the box according to the invention equipped with two stoppers, one forming the base and the other the lid.
Figure 5:
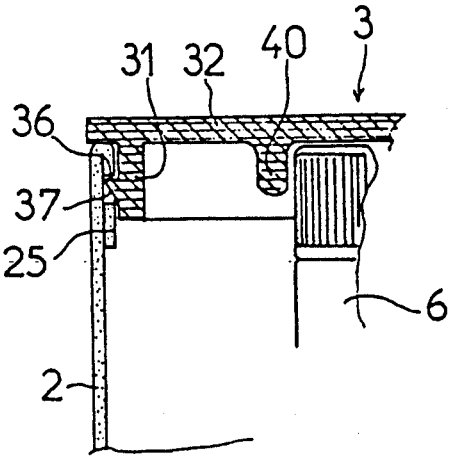
FIG. 5 is a partial sectional view of the positioning of the stopper forming the lid on the sleeve and the product to be packed.
Figure 4:
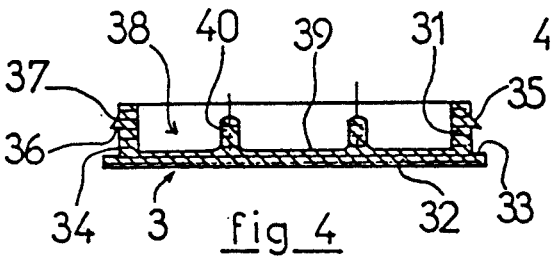
FIG. 4 is a sectional view of the stopper along 4—4.
Figure 3:
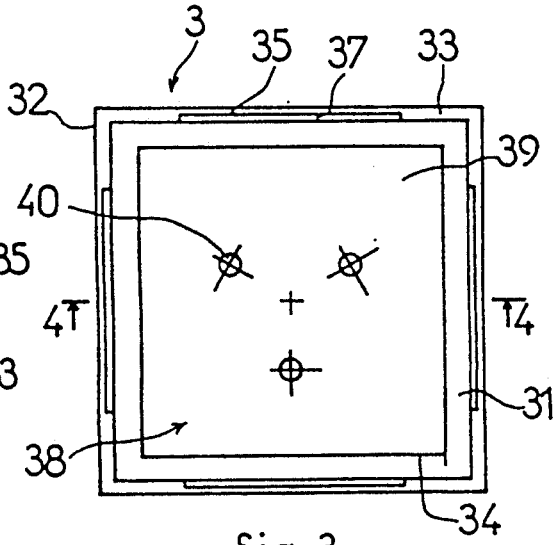
FIG. 3 is a top view of the inner face of the stopper.

The snap-lock box 1 according to the invention is shown in FIG. 1.

It consists of a cardboard sleeve 2, with a square section, combined with two independent stopping members or stoppers 3 forming the base and the lid of the box respectively.

Figure 2:
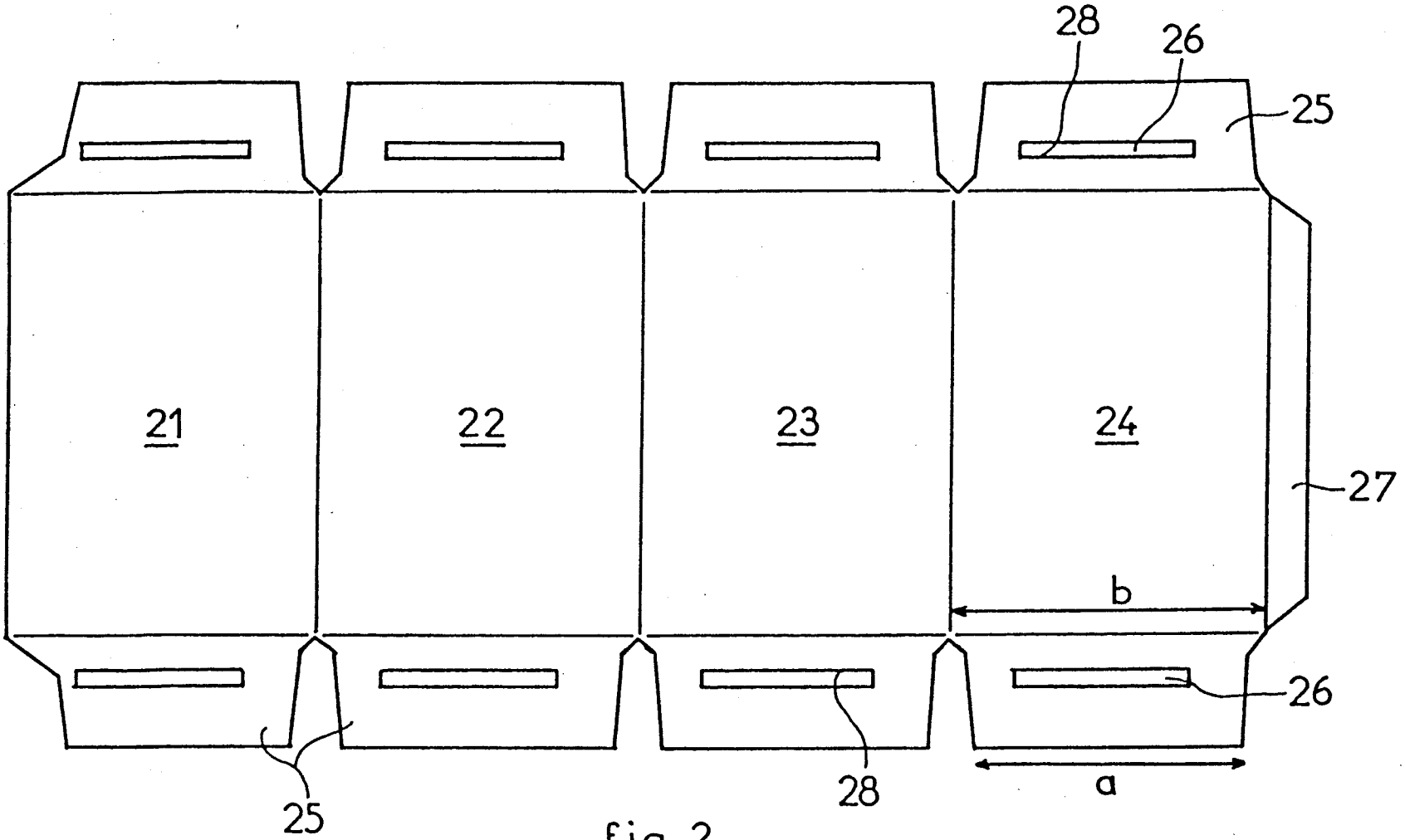
FIG. 2 is a view of the cardboard blank, when flat, forming the sleeve of the box.

The sleeve 2 is produced from a single cardboard blank, such as shown in FIG. 2. It has four rectangular lateral walls 21, 22, 23, 24 separated by folding lines and each extended, on each side, by locking tabs 25.

Each tab 25 has a width which is substantially less than the width b of the lateral walls 21, 22, 23, 24; they are separated from their respective wall element by folding lines and they each have an orifice 26 with a rectangular shape arranged in approximately the region of their central part.

The free side of the lateral wall 24 is equipped with an extension 27 in the form of a tongue intended to combine, for example, by adhesive bonding or stapling, the wall elements 24 and 21 when the sleeve 2 has been given a three-dimensional shape.

Once this joining has been achieved, and the lateral walls have been folded relative to each other to obtain the sleeve with a parallelepiped section and, in the embodiment shown, square section, the locking tabs 25 are folded back towards the inside in order to obtain the embodiment in FIG. 1. This folding back of the tabs 25 towards the inside is possible as a result of their width being less than that of the lateral walls.

Each end of the sleeve 2 is so equipped with a set of four tabs 25, each integral with a wall 21, 22, 23, 24 forming, in this region, a double thickness of cardboard.

Since the tabs 25 are joined to the lateral walls of the sleeve by the end folding line alone, these tabs 25 have a degree of elasticity and a tendency to come free slightly.

The orifices 26, and in particular their outer ridges 28, are intended to serve as anchoring means for a stopping member 3 at each end of the sleeve.

FIGS. 1, 3, 4 and 5 show one of the possible embodiments of the stopper 3.

This stopping member 3 is identical for the base and the lid; it is preferably made from plastic material and consists of a central body 31 with a general parallelepiped shape. It has dimensions such that it can just enter inside the ends of the sleeve 2.

This central body 31 is combined with a flat surface 32 forming a base or cap and having dimensions which are greater than the central body 31, so as to exhibit a peripheral shoulder 33.

The size of the cap 32 corresponds to at least that of the sleeve 2 and the shoulder 33 is intended to be positioned bearing against the end edge 4 or 5 of the sleeve.

In the embodiment shown in FIG. 1, the size of the flat surface 32 is substantially identical to that of the sleeve 2.

The central body 31 of the stopper 3 has a set of lugs 35 arranged laterally in the region of the flanks 34.

The lugs 35 are arranged substantially in the central region of the flanks 34 and are intended to interact with the outer ridges 28 of the orifices 26 of the tabs 25 in order to achieve, on each side, the locking of the box.

To this end, the lugs 35 are hook-shaped and have a triangular appearance in cross-section and they exhibit an outer side 36 parallel to the peripheral shoulder 33 and a slightly sloping side 37 joined to the flanks 34. These lugs 35 extend over slightly more than half the length of the flanks 34.

In order to ensure the locking of the box, the central body 31 of the stopper is inserted into the end of the sleeve. The tapered sides 37 of the lugs 35 press the upper parts of the tabs 25 back towards the lateral walls of the sleeve until the lugs 35 are completely engaged in the orifices 26.

As a result of their elasticity, the tabs 25 return towards the flanks 34 of the stopper and they lodge themselves between the peripheral shoulder 33 and the side 36 of the lugs, preventing any movement of the stopping member 3.

The peripheral shoulder 33 is limited in its movement by the end edge 4 or 5 and the lug 35, in the opposite direction, by the ridges 28 of the tabs 25.

To this end, the distance separating the shoulder 33 from the side 36 must be very slightly greater than the distance separating the end edges 4 or 5 from the ridges 28.

A locked box which is impregnable, except by damaging it, is thereby obtained.

The use of a rigid plastic material for producing the stoppers 3 enables a box to be obtained exhibiting end reinforcements; indeed, the central bodies 31, pressed flat against the walls 21, 22, 23, 24 of the sleeve 2 reinforce these walls, and to a large extent prevent the lateral crushing of the box 1.

Moreover, the inner face of the central bodies 31 may have recesses or moldings which are intended to save on the plastic material, and to ensure the positioning and wedge-fastening of the product in the packaging.

In the embodiment shown in the various figures, the box 1 is intended to serve for packing a bottle 6.

In order to achieve correct wedge-fastening and positioning of the bottle 6 in the box, the stoppers 3, which are identical, have a recess 38, the base 39 of which is equipped with a set of three studs 40.

The square recess 38 has sides which correspond substantially to the diameter of the cap of the bottle 6. The studs 40 of the stopper 3 forming the base of the packaging are housed in the lower molding of the bottle.

The three studs 40 of the stopper 3, forming the lid of the box, are intended to be placed around the top or the neck of the bottle.

The dimensions of the box are such that the two bases 39 of the stoppers 3 accurately clamp the bottom and top of the bottle 6 so as to ensure its lengthwise wedge-fastening, and hence the possibility of superposing various packagings with no risk of damage by crushing.

The base of the stoppers 3 will, of course, be shaped according to the nature of the product to be packaged.

The invention is not limited to the detail of the embodiments which have been described merely by way of example, it being possible for other alternatives to be produced without going beyond the protective scope defined by the claims.

A single stopper can thus be employed for producing, for example, the lid of the box, the base of this box being produced in the traditional manner, by extensions in the region of the blank.

The locking of the stoppers 3 onto the sleeve 2 may be produced by only three, or even two lugs, the constituent parts of the box then being adapted accordingly.

In order to reinforce the impregnable nature of the box, adhesive bonding of the tabs 25 onto the walls of the sleeve may also be provided.

The shape of the sleeve 2 and of the stoppers 3 may also vary being rectangular, polygonal, etc.

I claim:

1. Snap-lock box comprising:
   - a sleeve for containing a product having an inner wall, an outer wall, and at least two ends,
     - at least one of said two ends including
       - an edge surrounding an opening, and
       - at least one locking tab which is folded back against said inner wall of said sleeve, said at least one locking tab including means forming an anchoring orifice; and
     - at least one stopper comprising
       - a cap capable of bearing against said edge when inserted into the opening, with the size of the cap being sufficient to cover said edge,
       - a central body being dimensioned to be inserted into the opening and to substantially correspond to the dimensions of the inner wall, said central body having at least one side wall on which is arranged at least one lug which can cooperate with said means forming in anchoring orifice for maintaining said at least one stopper in position on said sleeve.

2. Snap-lock box according to claim 1, wherein said at least one locking tab is adhesively bonded to the inner wall of the sleeve.

3. Snap-lock box according to claim 1, wherein each side wall of said stopper includes a locking tab.

4. Snap-lock box according to claim 1, wherein said central body includes means for wedge-fastening the product.

5. Snap-lock box according to claim 4, wherein said sleeve includes two ends and two stoppers, with each central portion including means for wedge-fastening the product, whereby the product assists in maintaining the shape of the box.

6. Snap-lock box according to claim 5, wherein said wedge-fastening means include studs arranged in a recess of said central body so as to contact a top portion of the product and a lower portion of the product.

7. Snap-lock box according to claim 6, wherein the product comprises a bottle having a lower molded portion, and said studs are capable of being housed within said lower molded portion.

8. Snap-lock box according to claim 7, wherein there are three studs.

9. Snap-lock box according to claim 1, wherein said sleeve comprises a single cardboard blank.

10. Snap-lock box according to claim 1, wherein said at least one stopper is constructed from a plastic material.

11. Snap-lock box according to claim 1, wherein said lug is substantially triangular, and includes a sloping wall which presses against said at least one locking tab as said stopper is inserted into the opening.

* * * * *